United States Patent [19]

Leclerc

[11] Patent Number: 4,717,051

[45] Date of Patent: Jan. 5, 1988

[54] CHECK VALVE FOR WATER DISPENSER BOTTLE

[76] Inventor: Guy Leclerc, 900 de Nemours Street, Charlesbourg, Canada, G1H 7B3

[21] Appl. No.: 902,619

[22] Filed: Sep. 2, 1986

[51] Int. Cl.[4] ..... B67D 3/00

[52] U.S. Cl. ..... 222/545; 222/185; 141/364

[58] Field of Search ..... 222/181, 185, 499, 501, 222/507, 525, 531–532, 544–545, 559, 567; 141/2, 18, 291, 301, 356, 364; 251/339

[56] References Cited

U.S. PATENT DOCUMENTS

| | | | |
|---|---|---|---|
| 939,594 | 11/1909 | Fulper | 222/185 X |
| 991,568 | 5/1911 | Walter | 251/339 X |
| 1,538,483 | 10/1924 | Grantham | 141/352 |
| 2,453,080 | 11/1945 | Shimp | 222/185 |
| 3,081,004 | 3/1963 | Laughlin et al. | 222/162 X |
| 3,986,539 | 10/1976 | Bjerga | 251/339 X |
| 4,133,345 | 1/1979 | Mitchell | 251/339 X |
| 4,391,308 | 7/1983 | Steiner | 141/18 |
| 4,508,246 | 4/1985 | Grenn | 222/477 |

*Primary Examiner*—Joseph J. Rolla

*Assistant Examiner*—Michael S. Huppert

[57] ABSTRACT

A check valve for removably fitting the mouth of an invertible water bottle to be placed on a water dispenser, the bottle being made of synthetic resin and provided with an external circular rib at its mouth. The valve closes the mouth during water-bottle inversion until the check valve contacts an element of the water dispenser when the bottle is in inverted position and rests on a water dispenser. The check valve includes a cylindrical body adapted to be removably fitted over the water bottle mouth and having an outer closure wall provided with a central opening forming a tapered female valve seat. The check valve further includes a male valve member part having a disc-like head axially movable within the body between the mouth and the closure wall, a stem secured to the head and extending through the central opening of the closure wall, and a tapered male valve seat portion integral with the stem and adjacent the head. Upon water-bottle inversion, the water in the bottle acts upon the valve head to close the valve. An inward force exerted on the stem opens the valve.

3 Claims, 3 Drawing Figures

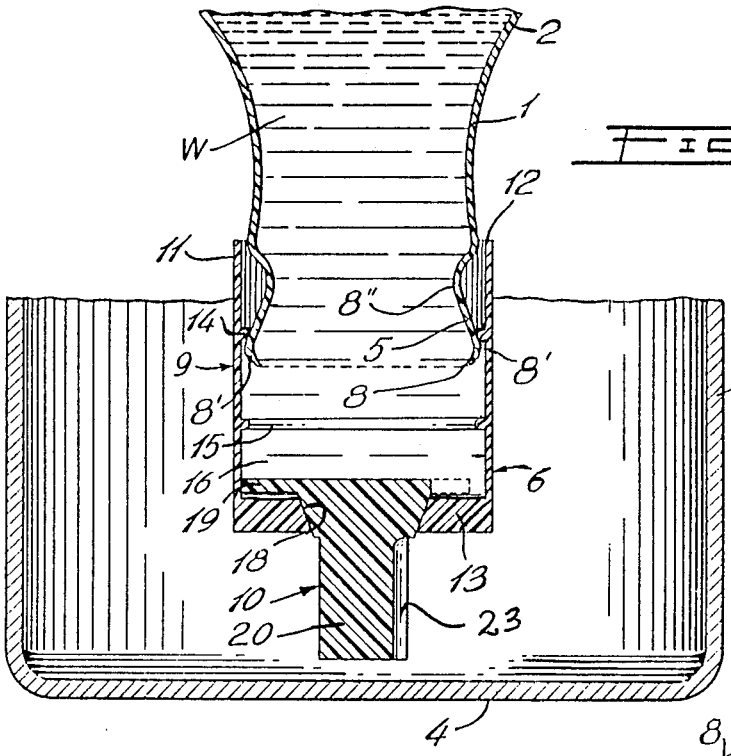
FIG. 1
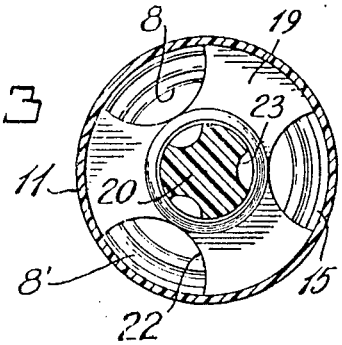
FIG. 3
FIG. 2
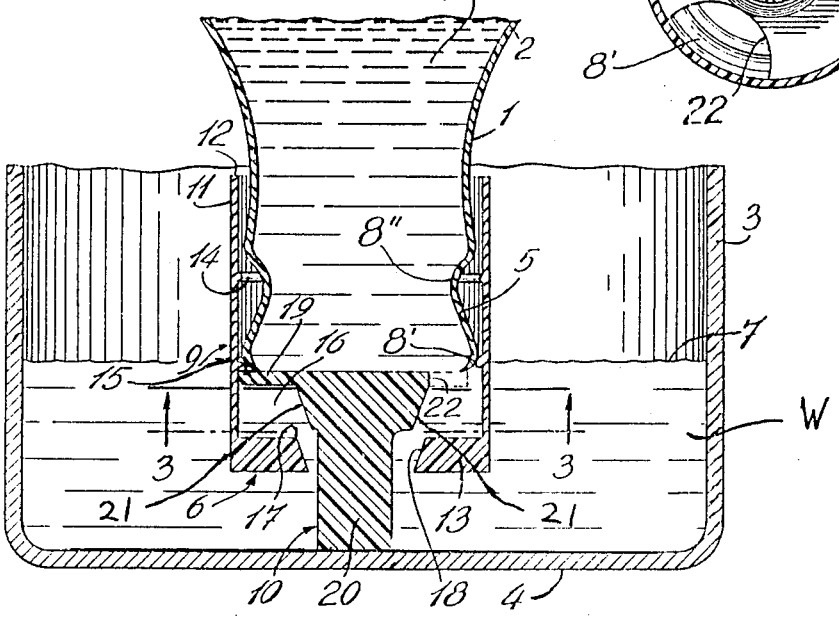

CHECK VALVE FOR WATER DISPENSER BOTTLE

FIELD OF THE INVENTION

The present invention relates to a check valve for use on water bottles of the type used in water dispensers.

BACKGROUND OF THE INVENTION

It is known to generally provide a check valve fitted to the mouth of a water bottle to prevent or reduce spillage of water while inverting the water bottle that is used in an invertible type water cooler and dispenser. The known check valves designed for this purpose were to be used in association with water bottles made of glass and are not suitable to be used on water bottles, such as now found on the market, and which are made of synthetic resin by a vacuum-forming process.

OBJECTS OF THE INVENTION

It is the general object of the present invention to provide a check valve of the character described, which is designed to fit water bottles made of synthetic resin by a vacuum-forming process.

It is another object of the invention to provide a check valve of the character described, which automatically opens when the bottle reaches its final inverted position on top of a water cooler and dispenser.

It is another object of the invention to provide a check valve of the character described, made essentially of two separate parts each molded out of synthetic resin.

SUMMARY OF THE INVENTION

The check valve of the present invention includes a body having a cylindrical wall open at its inner end and having a closure wall closing its outer end. This closure wall is thicker than said cylindrical wall and has a central circular opening, of decreasing diameter towards the outside of the body, and forming a female valve seat. Means are formed on the inside of said cylindrical wall to retain the body over the mouth of the water bottle with a snap-action by engagement with the conventional external rib of the water bottle.

Stop means are provided on the inside of the cylindrical wall to limit bottle-mouth insertion in the body. A valve member part is also provided, having a disc-like head disposed within the body and of greater diameter than that of the central opening. A stem is secured to the head and freely extends through the central opening and protrudes from the closure wall, and a tapered seat portion is formed around the stem adjacent the head and conforms with the female valve seat. Preferably, the means to releasably retain the body over the mouth and the stop means each consists of a circular rib formed inside said cylindrical wall and axially spaced from each other and from said closure wall, the rib forming the stop means being nearer said closure wall and having a smaller inside diameter than the other rib.

BRIEF DESCRIPTION OF THE DRAWINGS

In the annexed drawings illustrating a preferred embodiment of the invention:

FIG. 1 is a vertical section of the check valve of the present invention in closed position and fitted over the mouth of a water bottle for use in a water cooler and dispenser, said figure also showing in vertical section the water-receiving container of the dispenser;

FIG. 2 is a view similar to that of FIG. 1 but showing the valve in open position, the bottle having reached its downward limit position resting on the water cooler; and FIG. 3 is a plan section taken along line 3—3 of FIG. 2.

DETAILED DESCRIPTION OF THE DRAWINGS

There is shown in vertical section the neck part 1 of a water bottle, generally indicated at 2, the bottle being in inverted position within a partially-shown water-receiving container 3, having a bottom wall 4 which is a conventional integral part of a water cooler and dispenser (not shown in the drawings); the mouth 5 of the neck of the water bottle is fitted with the check valve 6 of the present invention.

In FIG. 1, the check valve does not yet contact the bottom 4 of the container 3 and is in closed position. In FIG. 2, the check valve contacts the bottom wall 4 in the final rest position of the water bottle as supported by the water cooler, and the valve is in open position, whereby the water W in the bottle may flow into the container 3 to the approximate level indicated at 7. The valve 6 is adapted to be releasably fitted over the mouth 5 of a water bottle of the type made of synthetic material by a vacuum-forming process and the mouth 5 of which includes, adjacent its opening 8, an external circular rib 8'. The bottle 2 is of uniform wall thickness, at least in the neck portion, and therefore its internal surface, indicated at 8'', is not cylindrical.

The valve assembly is made of two separate parts, each molded of synthetic resin, namely: a valve seat part formed by a body 9 and a valve member part indicated at 10. Body 9 is formed of a cylindrical wall 11 open at one end 12, while its other end is closed by a closure wall 13. A first internal rib 14 is formed at the inner surface of the cylindrical wall 11, spaced from the closure wall 13 and parallel thereto. This first rib 14 has a minimum internal diameter such that it will have an interference fit with the external rib 8' of the water bottle 1. The material of the bottle 1 having a certain resiliency, when the body 9 is fitted about the mouth 5 of the water bottle 1, the rib 8' of the latter will move past the internal rib 14 with a snap action. Rib 14 thus constitutes means to releasably retain the body 9 over the water bottle mouth 5 with a snap-action by engagement with the bottle external rib 8'.

A second internal rib 15 protrudes inside the cylindrical wall 11 and is parallel to the closure wall 13 and to the first rib 14, being disposed intermediate the same and axially spaced from each other. The second rib 15 serves as a stop means to limit bottle-mouth insertion in the body 9. In practice, the second rib 15 has a slightly-smaller inside diameter than that of the first rib 14. There is thus defined, between the mouth opening 8 and the closure wall 13, an internal space 16 within the body 9.

The closure wall 13 is provided with a central opening 17, of circular shape, and which progressively decreases in diameter towards the outside of the body 9. This surface of the central opening forms a female valve seat 18, of tapered shape. Closure wall 13 is thicker than wall 11.

The male valve member part 10 includes a disc-like flat head 19 from which integrally depends, centrally thereof, a generally cylindrical stem 20. The portion of the stem 20 adjacent the flat head 19 is enlarged and forms a tapered male valve seat 21, which fits within and conforms with the female valve seat 18 of the body 9. The flat head 19 is located within space 16 and has a sliding fit with cylindrical wall 11 and the stem 20 extends through central opening 17 and protrudes beyond closure wall 13. The flat head 19 is provided at its periphery with equally-spaced notches 22. Stem 20 is formed at its peripheral surface with axially-extending grooves 23.

The check valve is used as follows: the water bottle 1 is normally provided with a metal foil adhering and sealing the mouth opening 8. The bottle standing in upright position, the seal is removed and the body 9 fitted over the mouth 5 of the bottle. Upon water-bottle inversion, valve body 9 partially retracts from the bottle mouth opening 8 to an outer limit position in which the water bottle external rib 8' abuts against the first rib 14. However, male valve part 10 cannot move inwardly of the body 9 past the second rib 15. When the bottle has reached a position wherein its neck 1 is slightly downwardly inclined, the water emerging from the bottle will immediately act on the valve part 10 to close the valve.

No water spillage occurs. When the water bottle is fully inverted, body 9 is in extended position relative to bottle 2, as shown in FIG. 1, external rib 8' engaging first internal rib 14. As stem 20 strikes bottom 4, the valve opens and head 19 may cause more or less retraction of body 9, depending on the vertical location of bottom 4 relative to the water dispenser seat supporting bottle 2 in its final rest position. Thus, the valve can be used in association with different makes of water coolers.

What I claim is:

1. A check valve for removably fitting the mouth of an invertible water bottle to be placed on a water dispenser and for closing said mouth during water-bottle inversion until said check valve contacts an element of said water dispenser when said bottle is resting on said water dispenser in inverted position, said water bottle made of semi-resilient material and having a mouth formed with an external circular rib, said check valve formed of a valve seat part and of a separate valve member part, said valve seat part consisting of a body having a cylindrical wall open at one end, a closure wall at the other end of said cylindrical wall and having a central circular opening of decreasing diameter towards the outside of said body, and forming a female valve seat, means to releasably retain said body over said mouth by engagement with said bottle external circular rib, said valve member part having a disc-like head disposed within said body and of greater diameter than that of said central opening, a stem secured to said head, freely extending through said central opening and protruding from said closure wall, and a tapered male valve seat portion formed around said stem adjacent said head and conforming with said female valve seat, said stem of smaller cross-sectional area than the minimum diameter of said central opening, said valve member part axially movable towards the inside of said body from a valve-closing position in which said male valve seat portion contacts said female valve seat to a valve-opening position wherein said male valve seat portion is spaced inwardly from said female valve seat, and said head is spaced inwardly from said closure wall; further including a first internal circular rib, protruding from said cylindrical wall and constituting a stop for the mouth of said water bottle to limit insertion thereof into said body, so that it be spaced from said closure wall, said head having a slide fit with said cylindrical wall and provided with peripheral notches, said first internal circular rib serving as a stop engageable with said head to provide an inward limit position of said valve member part within said body.

2. A check valve as defined in claim 1, wherein said means to releasably retain said body over said mouth includes a second circular internal rib protruding from said cylindrical wall and axially spaced from said first internal circular rib in the direction of the open end of said cylindrical wall, said second circular internal rib having an interference fit with said bottle mouth external circular rib, so that the latter may be moved inwardly of said body past said second circular internal rib with a snap-action.

3. A check valve as defined in claim 2, wherein said stem is cylindrical and is provided with longitudinally-extending grooves at its external cylindrical surface to increase water flow through said check valve in its open position.

* * * * *